US005216917A

United States Patent [19]

Detournay

[11] Patent Number: 5,216,917

[45] Date of Patent: Jun. 8, 1993

[54] METHOD OF DETERMINING THE DRILLING CONDITIONS ASSOCIATED WITH THE DRILLING OF A FORMATION WITH A DRAG BIT

[75] Inventor: Emmanuel Detournay, Cambridge, England

[73] Assignee: Schlumberger Technology Corporation, Houston, Tex.

[21] Appl. No.: 728,442

[22] Filed: Jul. 11, 1991

[30] Foreign Application Priority Data

Jul. 13, 1990 [GB] United Kingdom ..... 9015433

[51] Int. Cl.[5] ..... E21B 44/00; E21B 47/00

[52] U.S. Cl. ..... 73/151; 73/151.5; 73/152; 175/39; 175/50

[58] Field of Search ..... 73/152, 151.5, 151; 175/39, 50

[56] References Cited

U.S. PATENT DOCUMENTS 4,627,276 12/1986 Burgess et al. ..... 73/151
4,697,650 10/1987 Fontenot ..... 175/50
4,876,886 10/1989 Bible et al. ..... 73/151.5

FOREIGN PATENT DOCUMENTS 0163426A 12/1985 European Pat. Off. .
0350978A 1/1990 European Pat. Off. .
2188354A 9/1987 United Kingdom .

*Primary Examiner*—Hezron E. Williams
*Assistant Examiner*—Michael Brock
*Attorney, Agent, or Firm*—John J. Ryberg; Wayne I. Kanak

[57] ABSTRACT

This invention is based on a new model describing the drilling process of a drag bit and concerns a method of determining the drilling conditions associated with the drilling of a borehole through subterranean formations, each one corresponding to a particular lithology, the borehole being drilled with a rotary drag bit, the method comprising the steps of: measuring the weight W applied on the bit, the bit torque T, the angular rotation speed $\omega$ of the bit and the rate of penetration $\nu$ of the bit to obtain sets of data ($W_i$, $T_i$, $\nu_i$, $\omega_i$) corresponding to different depths; calculating the specific energy $E_i$ and the drilling strength $S_i$ from the data ($W_i$, $T_i$, $\nu_i$, $\omega_i$); identifying at least one linear cluster of values ($E_i$, $S_i$), said cluster corresponding to a particular lithology; and determining the drilling conditions from said linear cluster. The slope of the linear cluster is determined, from which the internal friction angle $\phi$ of the formation is estimated. The intrinsic specific energy $\epsilon$ of the formation and the drilling efficiency are also determined. Change of lithology, wear of the bit and bit balling can be detected.

26 Claims, 5 Drawing Sheets

E
38
40
$p^h, p^p$
FL
$\mu\gamma = \beta\zeta$
CP ($\eta$=1)
36
$\eta$
$E^\gamma$
$\varepsilon$
$E_0$
32
34
$E^c = \varepsilon$
$\chi$
$1/\zeta$
0
S E
FL
$\mu\gamma = \beta/\zeta$
$E^\gamma$
$\varepsilon$
CP ($\eta$=1)
$E^c = \varepsilon$
$1/\zeta$
$\chi$
0
S
$E_0$

METHOD OF DETERMINING THE DRILLING CONDITIONS ASSOCIATED WITH THE DRILLING OF A FORMATION WITH A DRAG BIT

The present invention relates to a method of determining the drilling conditions associated with the drilling of a formation with a rotating drillbit. The invention allows the determination of characteristics of the formation and/or the drillbit.

The rotary drillbits concerned by the invention can generally be referred to as "drag bits", which are composed of fixed cutters mounted at the surface of a bit body. A well-known type of drag bit used in the oilfield industry is the polycrystalline diamond compact (PDC) drilling bit. A PDC rock drilling bit consists of a number of polycrystalline diamond compacts bonded on tungsten carbide support studs, which form the bit cutters rigidly mounted at the surface of the bit body. This type of drillbit is for example described in European Patent Number 0,193,361. By rotating a drag bit and pressing it on the formation to be drilled, the cutters drag on the surface of the formation and drill it by a shearing action. Hereafter the term "drillbit" or "bit" is used to designate a rotary drag bit.

Several methods have been developed and are being used in the field to determine the drilling conditions of roller-cone drillbits. The drilling of a formation with a roller-cone bit is the result of a gouging and indentation action. For example, U.S. Pat. No. 4,627,276 relates to a method for estimating the wear of roller-cone bits during oilwell drilling, by measuring several parameters (the weight applied on the bit, the torque required to rotate the bit and the speed of rotation of the bit) and then by interpreting the measured parameters. However, the interpretation of drilling data, such as weight-on-bit and torque data, obtained when drilling with a drag bit has not been successful so far and has lead to erratic results. Consequently, it is believed that no method exists presently to obtain valuable information on the rock being drilled with a drag bit and/or on the efficiency of the drillbit itself and, generally speaking, on the drilling conditions, in spite of the fact that drag bits have been used for many years.

The present invention aims at solving this problem and proposes a method of determining the drilling conditions when drilling an underground formation or a rock with a rotary drillbit of the drag bit type. Hereafter the term "formation" and "rock" are used interchangeably to designate an underground formation or a rock sample. The characteristics which are determined relate to the formation itself e.g. the "intrinsic specific energy" $\epsilon$ (as hereinafter defined) and the internal friction angle $\phi$ of the rock, to the drilling process e.g. the detection of bit balling and the drilling efficiency $\eta$ and $\chi$, to a change in the lithology while drilling, and to the drillbit itself e.g. state of wear and efficiency.

More precisely, the present invention relates to a method of determining the drilling conditions associated with the drilling of a borehole with a rotary drag bit through subterranean formations corresponding to particular lithologies, comprising the steps of:

measuring the weight W applied on the bit, the bit torque T, the angular rotation speed $\omega$ of the bit and the rate of penetration $\nu$ of the bit to obtain sets of data ($W_i$, $T_i$, $\nu_i$, $\omega_i$) relating to different depths;

calculating the specific energy $E_i$ and the drilling strength $S_i$ from the data ($W_i$, $T_i$, $\nu_i$, $\omega_i$);

identifying linear clusters of values ($E_i$, $S_i$), each corresponding to a particular lithology; and determining the drilling conditions from said linear cluster.

The invention also relates to a method of determining the efficiency of at least one drag drillbit comprising the steps of:

drilling a substantially uniform rock of known properties with the drillbit;

measuring the weight-on-bit W, the torque T, the bit rate of penetration $\nu$ and the angular velocity of the bit $\omega$ to obtain sets of data ($W_i$, $T_i$, $\nu_i$, $\omega_i$);

calculating the specific energy $E_i$ and the drilling strength $S_i$ from the data ($W_i$, $T_i$, $\nu_i$, $\omega_i$);

identifying a linear cluster of values ($E_i$, $S_i$); and determining the drillbit efficiency from said linear cluster.

The ratio of the variation of E over the corresponding variation of S is advantageously determined as this is related to the product of a bit constant $\gamma$ and a friction coefficient $\mu$.

The present invention will now be described in more detail and by way of example with reference to the accompanying drawings, in which.

The present invention is based on a model describing the interaction of a drag drillbit with the formation being drilled. To better understand the invention, the meaning of the parameters being determined is given herebelow in the Technical Background.

TECHNICAL BACKGROUND

Figure 1:
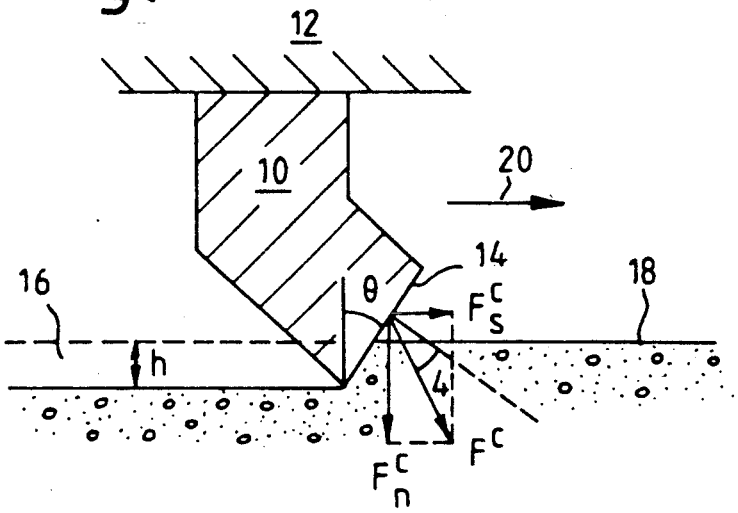
FIG. 1 represents schematically a sharp PDC cutter drilling a rock.

FIG. 1 represents schematically a cutter 10 fixed at the surface of the body 12 of a drillbit. The drillbit comprises a plurality of cutters identical to cutter 10, located on several circumferential rows centred around the bit rotational axis. Each cutter is composed of a stud having a flat cutting face 14 on which a layer of hard abrasive material is deposited. In the case of a PDC cutter, the hard abrasive material is a synthetic polycrystalline diamond bonded during synthesis onto a tungsten carbide/cobalt metal support.

A model describing the action of a single cutter, first perfectly sharp and then blunt is considered and extrapolated to a model of a drill bit.

Sharp cutter. In FIG. 1, a perfectly sharp cutter 10 traces a groove 16 of constant cross-sectional area s on a horizontal rock surface 18. It is assumed that the cutter is under pure kinematic control, i.e. the cutter is imposed to move at a prescribed horizontal velocity in the direction indicated by the arrow 20, with a zero vertical velocity and with a constant depth of cut h. As a result of the cutting action, a force $\vec{F}^c$ develops on the cutter. $F_n^c$ and $F_s^c$ denote the force components that are respectively normal and parallel to the rock surface, $\vec{F}^c$ being the product of these forces. Theoretical and experimental studies suggest that, for drag bits, $F_n^c$ and $F_s^c$ are both proportional to the cross-sectional area s of the cut and are given by:

$$F_s^c = \epsilon s \quad (1)$$

$$F_n^c = \zeta \epsilon s \quad (2)$$

where $\epsilon$ is defined as the intrinsic specific energy and $\zeta$ is the ratio of the vertical to the horizontal force acting on the cutting face. The quantity $\epsilon$ has the same dimension as a stress (a convenient unit for $\epsilon$ is the MPa). The intrinsic specific energy $\epsilon$ represents the amount of energy spent to cut a unit volume of rock by a pure cutting action with no frictional action.

The intrinsic specific energy depends on the mechanical and physical properties of the rock (cohesion, internal friction angle, porosity, etc.), the hydrostatic pressure of the drilling fluid exerted on the rock at the level of the drillbit and the rock pore pressure, the backrake angle $\theta$ of the cutter, and the frictional angle $\psi$ at the interface rock/cutting face.

The backrake angle $\theta$, as illustrated in FIG. 1, is defined as the angle that the cutting face 14 makes with the normal to the surface of the rock and the friction angle $\psi$ is the angle that the force $F^c$ makes with the normal to the cutting face.

Note that $\zeta$, the ratio of $F_n^c$ over $F_s^c$ can be expressed as $$\zeta = \tan(\theta + \psi) \quad (3)$$

Figure 2:
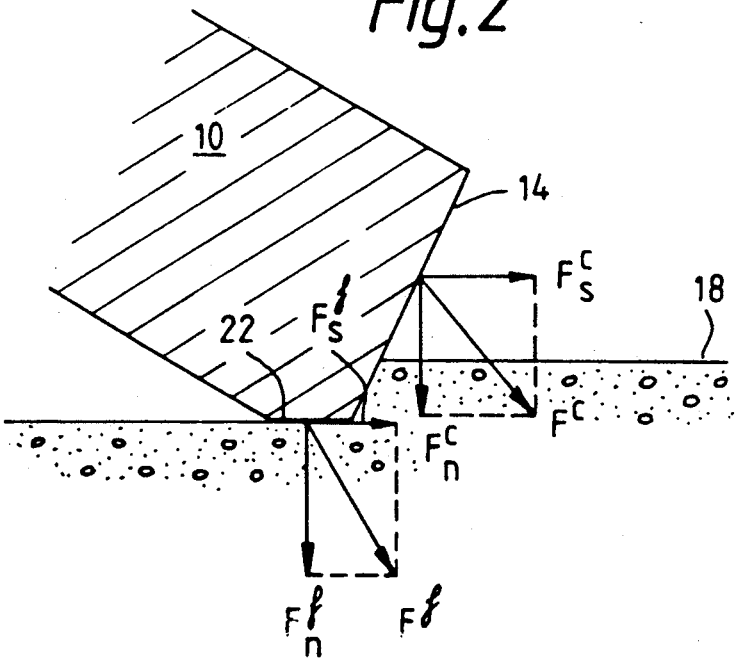
FIG. 2 illustrates the different forces acting on a blunt PDC cutter while drilling a rock.

Blunt cutter. The case of a cutter with a wear flat is illustrated in FIG. 2. During drilling, the sharp surface of the cutter in contact with the rock becomes smooth and a wear flat surface 22 develops. As a consequence, the friction of the cutter on the surface of the rock becomes important. The drilling process is then a combination of a cutting and frictional action.

The cutter force $\vec{F}$ is now decomposed into two vectorial components, $\vec{F}^c$ which is transmitted by the cutting face 14, and $\vec{F}^f$ acting across the wear flat 22. It is assumed that the cutting components $F_n^c$ and $F_s^c$ obeys the relations (1) and (2) for a perfectly sharp cutter. It is further assumed that a frictional process is taking place at the interface between the wearflat 22 and the rock; thus the components $F_n^f$ and $F_s^f$ are related by $$F_s^f = \mu F_n^f \quad (4)$$

where $\mu$ is a coefficient of friction.

The horizontal force component $F_s$ is equal to $F_s^c + F_s^f$, and the vertical force component $F_n$ is equal to $F_n^c + F_n^f$. Using equations (1) and (4), the horizontal component $F_s$ can be expressed as $$F_s = \epsilon s + \mu F_n^f \quad (5)$$

Writing $F_n^f$ as $F_n - F_n^c$ and using equation (2), this equation becomes $$F_s = (1 - \mu\zeta)\epsilon s + \mu F_n \quad (6)$$

Two new quantities are now introduced: the specific energy E defined as $$E = \frac{F_s}{s} \quad (7)$$

and the drilling strength S $$S = \frac{F_n}{s} \quad (8)$$

Both quantities, specific energy E and intrinsic specific energy $\epsilon$, have obviously the same general meaning. However, E represents the energy spent by unit volume of rock cut, irrespective of the fact that the cutter is sharp or worn, when cutting and frictional contact processes are taking place simultaneously, while $\epsilon$ is meaningful only for the cutting action, with no dissipation of energy in a frictional contact process.

For a perfectly sharp cutter, the basic expressions (1) and (2) combined with the definitions (7) and (8) lead to:

$$E = \epsilon \text{ and } S = \zeta\epsilon \quad (9)$$

For a worn cutter, the following linear relationship exist between E and S, which is simply obtained by dividing both members of equation (6) by s:

$$E = E_0 + \mu S \quad (10)$$

where the quantity $E_0$ is defined as $$E_0 = (1 - \mu\zeta)\epsilon \quad (11)$$

Model of a Drillbit

The action of a single cutter described above can be generalised to a model describing the action of a drillbit which is based on the fact that two processes, cutting and frictional contact, characterize the bit-rock interaction. The torque T and weight-on-bit W can thus be decomposed into two components, i.e.

$$T = Tc + Tf \text{ and } W = Wc + Wf \quad (12)$$

c and f referring to cutting and friction respectively. The main results of the generalisation are that a drillbit constant $\gamma$ intervenes in equation (10) which then becomes $$E = E_0 + \mu\gamma S \quad (13)$$

and equation (11) becomes $$E_0 = (1 - \beta)\epsilon \quad (14)$$

with $$\beta = \gamma\mu\zeta \quad (15)$$

In the above, $\gamma$ is a bit constant, which depends on the bit profile, the shape of the cutting edge, the number of cutters and their position on the bit. The magnitude of $\gamma$ is greater than 1. For a flat-nose bit with a straight cutting edge, the theoretical range of variation of $\gamma$ is between 1 and 4/3. The lower bound is obtained by assimilating the bit to a single blade, the upper one to a frictional pad.

The parameter $\mu$ is the friction coefficient defined by equation (4). For the values of W encountered in practise, the parameter $\mu$ is believed to be representative of the internal friction angle $\phi$ of the rock (i.e. $\mu=\tan\phi$), rather than the friction angle at the wearflat/rock interface. The internal friction angle $\phi$ is an important and well-known characteristic of a rock.

Equation (13) defines the possible states of the bit/rock interaction, with a limit, however, which is that the maximum efficiency of the drilling process is achieved when all the energy applied to the drillbit is used for cutting the rock, with no frictional process. This corresponds to equation (9) which states that $E=\epsilon$ and $S=\zeta\epsilon$.

The drilling states must therefore correspond to $E\geqq\epsilon$ or equivalently $S\geqq\zeta\epsilon$. The drilling efficiency can be defined by a dimensionless parameter $\eta$:

$$\eta = \frac{\epsilon}{E} \tag{16}$$

The maximum efficiency $\eta=1$ corresponds to $E=\epsilon$ and $S=\zeta\epsilon$.

Since it is not always possible to determine $\eta$, it is convenient to introduce the quantity $\chi$, which is defined as the ratio of the specific energy to the drilling strength, i.e.

$$\chi = \frac{E}{S} \tag{17}$$

Note that a simple relation exists between $\chi$ and the efficiency $\eta$:

$$\eta = \frac{\chi - \mu\gamma}{(1-\beta)\chi} \tag{18}$$

The parameter $\chi$ varies between $\zeta^{-1}$ and $\mu\gamma$ as the efficiency decreases from 1 to 0.

The drilling efficiency $\eta$ depends on several parameters, among them the wear state of the bit and the "hardness" of the rock. For that purpose, equation (16) for $\eta$ is rewritten as $$\eta = \frac{\epsilon}{\epsilon + \mu\gamma\frac{W^f}{a\,\delta}} \tag{19}$$

In the above equation, the symbol a designates the radius of the bit and $\delta$ is the depth of cut per revolution. The component of weight-on-bit $W^f$ that is transmitted by the cutter wear flats can be expressed as $$W^f = A^f\sigma \tag{20}$$

where $A^f$ is the combined area of the projection of all the cutter contact surfaces onto a plane orthogonal to the axis of revolution of the bit, and $\sigma$ is the average contact stress transmitted by the cutter wearflats. Furthermore, we define the contact length $\lambda$ as $$\lambda = A^f/a \tag{21}$$

There is a threshold on the component of weight-on-bit transmitted by the cutter contacts, i.e.

$$W^f \leqq W^{*f} \tag{22}$$

The threshold value $W^{*f}$ depends on the wear state of the bit, the rock being drilled, the mud pressure, etc; it can expressed as $$W^{*f} = a\lambda^*\sigma^* \tag{23}$$

where $\sigma^*$ is the contact strength or hardness (function of the rock, mud pressure, pore pressure, . . . ) and $\lambda^*$ is the fully mobilized contact length, characteristic of a certain wear state of the bit. As more weight-on-bit is imposed on the bit, the contact component of the weight-on-bit, $W^f$ increases progressively until it reaches the threshold value $W^{*f}$ (the increase of $W^f$ is due to a combination of an increase of the contact length $\lambda$ and the contact stress $\sigma$).

The drilling efficiency $\eta$ can now be rewritten as $$\eta = \frac{\epsilon}{\epsilon + \mu\gamma\lambda\,\sigma/\delta} \tag{24}$$

Note that under conditions where the threshold weight-on-bit is reached, then $\lambda\sigma=\lambda^*\sigma^*$.

The drilling efficiency $\eta$, which gives a relative measure of the energy dissipated in frictional contact at the bit, is seen to be sensitive to the contact length and the contact stress. It is actually useful to determine directly the product $\lambda\sigma$, which provides a combined measure of the wear state of the bit and the strength of the rock. This product is calculated according to $$\sigma\lambda = \frac{\delta(E-\epsilon)}{\mu\gamma} \tag{25}$$

Determination of E and S

In accordance with the present invention, the drilling specific energy E and the drilling strengths are periodically calculated so as to derive valuable information on the formation and the drillbit.

Given a set of measurements of the weight-on-bit W, the torque T, the penetration rate $\nu$ and the rotational speed $\omega$, the drilling specific energy E and the drilling strength S are calculated as follows:

$$E = \frac{2T}{a^2\delta} \tag{26}$$

$$S = \frac{W}{a\delta} \tag{27}$$

In the above equations, the symbol a designates the radius of the bit and $\delta$ is the depth of cut per revolution calculated as $$\delta = \frac{2\pi\nu}{\omega} \tag{28}$$

Both E and S have the dimension of a stress (Force per unit area); a convenient unit for E and S is the MPa ($N/mm^2$). Under normal operating conditions of a PDC bit, $E<1{,}000$ MPa, and $S<2{,}000$ MPa.

The weight applied on the bit W, the torque T, the penetration rate $\nu$ and the rotational speed $\omega$ are measured periodically so as to acquire sets of measurements, for example one data set per 30 centimeters drilled. From each set (W, T, $\nu$, $\omega$), the drilling specific energy E and the drilling strength S are computed according to equations (26) and (27). Notation $E_i$ and $S_i$ is used hereafter to designate the value of the specific energy and drilling strength corresponding to the acquisition number i of a particular set of measurements. The pair ($E_i$, $S_i$) is thus representative of the depth interval corresponding to the acquisition number i.

The parameters T, W, $\nu$ and $\omega$ can be measured at the surface or at the bottom of the hole by conventional equipment used now commercially in the drilling industry.

The methods and apparatus commercially available in the drilling industry for measuring these parameters are well-known. For surface measurements, and as examples only, the torque T could be obtained by using the torquemeter described in U.S. Pat. No. 4,471,663; the weight-on-bit W by using the method described in U.S. Pat. No. 4,886,129; and the penetration rate $\nu$ by using the method described in U.S. Pat. No. 4,843,875. For downhole measurements, an MWD tool is used. For measuring the torque T and the weight-on-bit W, the apparatus described in U.S. Pat. Nos. 3,855,857 or 4,359,898 could be used. Measurements are made periodically at a frequency which could vary between 10 centimeters to 1 meter of the formation being drilled or between 1 to 3 minutes. It should be noted that the data used for the determination of E and S can correspond to average values of the measured parameters over a certain period of time or drilled depth. This is more especially true for the penetration rate $\nu$ and the rotational speed $\omega$.

Diagram E-S

In accordance with one embodiment of the invention a diagram representing the values of E versus S is built by plotting each pair ($E_i$, $S_i$) calculated from one set of measurements on a diagram representing E versus S.

Figure 3:
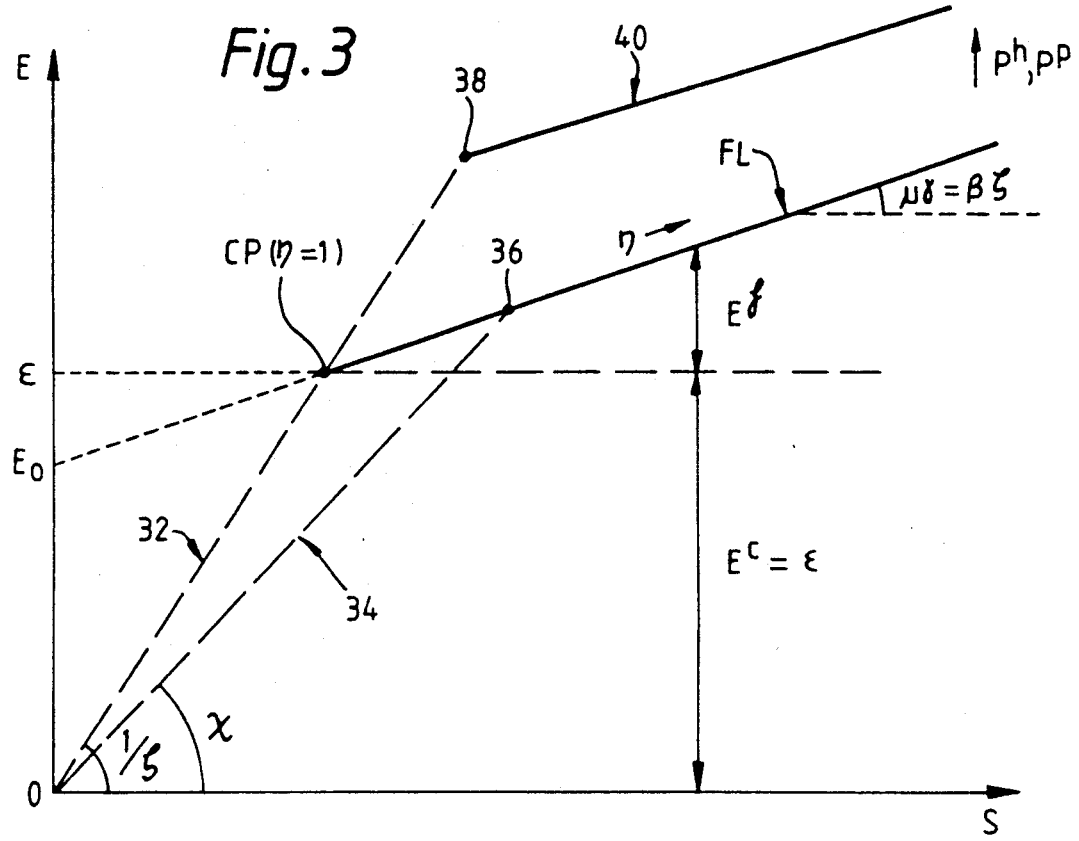
FIG. 3 represents the diagram E-S (for $\beta<1$) in accordance with the invention and the different parameters which can be determined when practising the invention.

FIG. 3 represents the diagram E-S. Equation (13) is represented by a straight line FL, called friction line, of slope $\mu\gamma$ (which is equal to $\beta/\zeta$ in accordance with equation (15)). In FIG. 3, the friction line FL has been represented for values of $\beta$ smaller than 1, which covers the general case. The friction line FL intercepts the E-axis at the ordinate $E_0$ (from equation (13), with $S=0$). Admissible states of the drilling response of a drag bit are represented by all the points on the friction line FL. However, the drillbit efficiency $\eta$ is at a maximum equal to 1. This corresponds to equation (9) for which all the drilling energy is used in cutting the rock, i.e. there is no friction. Equations (9) lead to $E=s/\zeta$. Consequently, the point CP (called "cutting point") on the friction line FL corresponding to the efficiency $\eta=1$ is at the intersection of the friction line with the line 32 representing the equation $E=s/\zeta$ which is a straight line passing by the origin 0 and having a slope $1/\zeta$. This line 32 is the locus of the cutting points. The admissible states of the drilling response of the bit are therefore located on the right side of the cutting point CP on the friction line, corresponding to $\eta \leqq 1$.

As the efficiency of the drillbit decreases the friction line moves towards the right, because more and more drilling energy is consumed into friction. As a fact, $E=\epsilon$ (equation (16)) corresponds to $\eta=1$ (and to the cutting point CP) and therefore the horizontal line of ordinate $\epsilon$, passing through CP, represents the component $E^c$ of the drilling specific energy which is used effectively in the cutting process, the other component $E^f$ represented in FIG. 3 by the vertical distance between $E=\epsilon$ and the friction line FL corresponding to the drilling specific energy dissipated in frictional processes.

The dimensionless quantity $\chi$, defined by $E=\chi S$ (equation (17)) is represented by the slope of the straight line 34 going through the origin 0 and a particular point 36 on the friction line defined by its coordinates ($S_i$, $E_i$). This quantity $\chi$ gives an indication of the efficiency $\eta$ of the drilling process at the particular point ($S_i$, $E_i$) (equation (18)) and is particularly interesting to obtain when the determination of the cutting point CP is not easy and therefore when $\epsilon$ and $\eta$ are difficult to determine. The parameter $\chi$ varies between $1/\zeta$ for $\eta=1$ to $\mu\gamma$ when $\eta=0$.

Finally, it should be noted that the intrinsic specific energy $\epsilon$ and the contact strength $\sigma$ are parameters that depend significantly on the mud pressure $p^h$ and the pore pressure pP. Both $\epsilon$ and $\sigma$ increase with increasing mud pressure $p^h$ but decrease with increasing pore pressure pP. All the other quantities, $\zeta$, $\mu$ and $\gamma$ are practically independent of the mud pressure. In FIG. 3, an increase of the mud pressure (all other conditions remaining the same) causes an increase of the intrinsic specific energy $\epsilon$ and therefore causes the cutting point CP to move up on the line 32 to point 38 (line 32 is the locus of the cutting points), displacing with it the friction line FL to the parallel friction line 40 indicated in FIG. 3. It should also be noted that a variation of pore pressure pP of the formation produces the same effect, i.e. a parallel displacement of the friction line FL.

Figure 4:
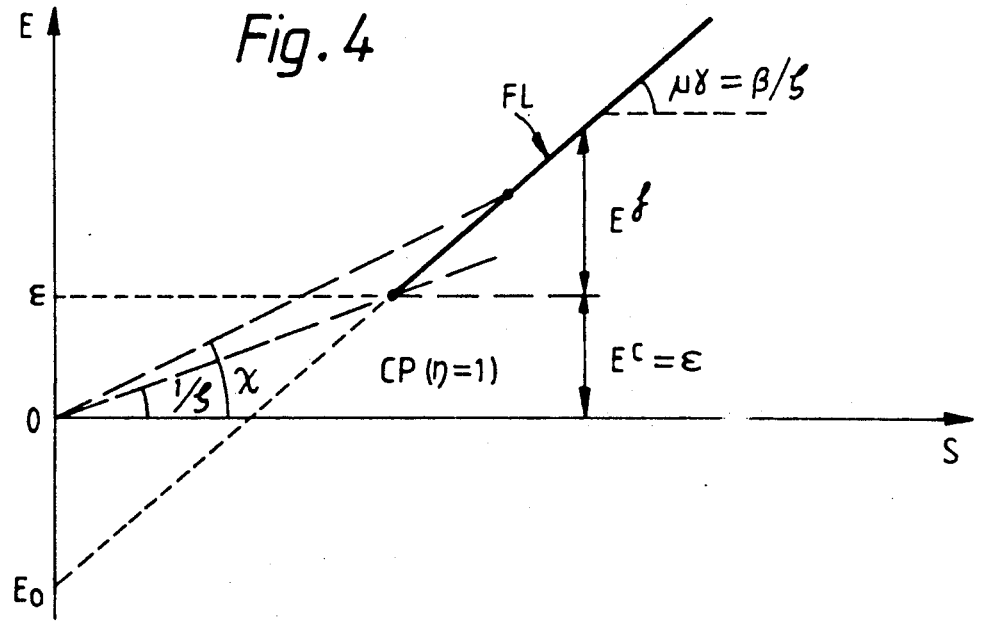
FIG. 4 represents the diagram E-S, as in FIG. 3 but for $\beta>1$.

FIG. 4 is the diagram E-S, representing equation (13) but now with $\beta<1$ (FIG. 3 was for $\beta<1$). Here $E_0$ is negative, which means that if the weight-on-bit W is kept constant, the torque T increases with a decreasing drilling efficiency. The states of diminishing efficiency are characterised by increasing values of the slope $\chi$.

Applicant has discovered that under constant in situ conditions (rock, drilling fluid pressure, and pore pressure constant), the drilling response (T and $\nu$) fluctuates at all times, but in such a way that equation (13) is satisfied. In other words, the repartition of power at the bit, between cutting and frictional processes (i.e. the efficiency) is changing all the time. Thus the various drilling states of a bit run under uniform conditions will be mapped as a substantially linear cluster of points in the diagram E-S of FIGS. 3 or 4. All the points that appear to define a linear cluster in the space E-S can be identified to quasi-uniform in situ conditions (i.e. same lithology, and constant drilling fluid pressure and pore pressure). Ideally, a linear cluster would be reduced to a straight line, i.e. a friction line FL. The spreading of points in a particular cluster is due to several reasons, and is best understood by considering the equation (24), which shows that in a given formation, the drilling efficiency $\eta$ depends on:

1 the depth-of-cut per revolution $\delta$; this opens the possibility of imposing systematic variation of the drilling parameters (weight-on-bit and rotational speed) to force different states of the system along the friction line so as to draw it precisely.

2 the contact length $\lambda$; in other words the efficiency is sensitive to the total area of the contact underneath the cutters. This contact length is not expected to remain stationery as the cutters are going through cycles of wear and self-sharpening.

the contact stress $\sigma$; there are theoretical and experimental arguments to support the view that the contact stress (or the contact strength) is much more sensitive to variation of the physical characteristics of the rock (such as porosity) than the intrinisic specific energy. In other words, drilling of a particular formation is characterized by a fairly constant $\epsilon$, but less uniform $\sigma$ (the variation of $\sigma$ being thus more sensitive to the finer scale variation of the rock properties).

Determination of bit wear and bit balling

Another step of the invention involves the identification of the various linear clusters in the diagram E-S. Since the drilling fluid pressure and pore pressure evolve in general slowly, each cluster corresponds to a different lithology. Some confidence in the correct identification of a cluster can be gained by checking whether the cluster is indeed composed of sequential pairs ($E_i$, $S_i$). Exceptions exist however which defeat this verification procedure: for example a sequence of alternating beds cause the drilling response to jump between two clusters, every few points. When the bit is very sharp, the cluster of points in the E-S plot will be compact and close to the cutting point CP because most of the drilling energy is used for cutting the rock and very little is dissipated in friction. As the bit is wearing down, the cluster will migrate towards the right on the friction line and will also stretch because more and more energy is dissipated in friction. The effect of wear on the drilling response of drag bits is however very much controlled by the strength of the rock being drilled. In harder rock, the drilling response of a worn bit is characterised by greater fluctuations of the torque and rate of penetration, and generally by a lower efficiency. In the E-S plot, these characteristics correspond to a cloud of points which is more elongated and positioned further away from the optimal operating point of the case of hard rock. One of the reasons behind this influence of the rock strength on the drilling response of a worn bit is the relationship between the maximum stresses that can be transmitted across the cutter wear-flats and the strength of the rock: the harder the rock, the greater the maximum components of weight-on-bit that are associated with the frictional processes.

Bit balling has the same signature as bit wear in the E-S diagram. Occurrence of bit balling is generally associated with the drilling of soft shales and a bad cleaning of the bit, the drilled cuttings sticking to the bit. When the bit is balling up, part of the torque is used to overcome a frictional resistance associated with the relative sliding of the shale sticking to the bit body with respect to the shale still in place (taking here shale as an example). So again, the image points of the drilling states should lay on a friction line in the E-S diagram when there is a bit balling. Obviously, the previous picture of frictional processes underneath the cutters does not strictly hold for bit balling, and therefore one should not expect the bit constant $\gamma$ to be the same. It can be shown that $\gamma=4/3$ if the bit is behaving as a flat frictional pad. In the absence of further information, it will be assumed that the $\gamma$ constant is in the range 1–1.33 for bit balling.

The fundamental effect of both bit wear and bit balling is actually to increase the contact length $\lambda$ (this variation of $\lambda$ will impact on the drilling efficiency $\eta$, according to (24)). As has been discussed previously, this contact length cannot be extracted directly from the drilling data, only the "contact force" $\lambda\sigma$. This contact force $\lambda\sigma$ thus represents the best quantity available to estimate bit wear or bit balling, and can be computed from (25), provided that the intrinsic specific energy $\epsilon$ and the slope $\mu\gamma$ have been estimated.

Significant increase of the contact force $\lambda\sigma$ can at the minimum be used as a means to diagnose unusual bit wear and bit balling. It is generally possible to distinguish between these two causes. Indeed, bit balling tends to occur in "soft" formations, that are characterized by rather small values of the friction coefficient $\mu$ (typically less than 0.5) but relatively large values of the intrinsic specific energy $\epsilon$, while the influence of bit wear on the drilling response will be more marked in "hard" formations, that are generally characterized by higher values of $\mu$ (typically above 0.5) but relatively small values of $\epsilon$.

Obviously, it is only if the contact stress $\sigma$ could be assessed independently that the contact length $\lambda$ could be extracted from the drilling data. However, in fairly homogeneous formations, there is ground to believe that $\sigma$ will remain approximately constant. In that case, variation of the contact force $\lambda\sigma$ can mainly be attributed to change in the contact length, and thus relative change of $\lambda$ can at least be tracked down.

Interpretation of the drilling data

The steps to be taken, for reducing the data and identifying constant in situ conditions, consist therefore in:

calculate the pair ($E_i$, $S_i$) for each depth interval from the raw data ($W_i$, $T_i$ $\nu_i$,$\omega_i$);

plot the pairs ($E_i$, $S_i$) in the diagram E-S;

identify linear clusters in this diagram.

Once a linear cluster of points has been recognised, several quantities can be computed or identified.

Estimate of $E_0$ and $\mu\gamma$. First, best estimates of the two parameters $E_0$ and $\mu\gamma$ that characterise the friction line are obtained by carrying out a linear regression analysis on the data points that belongs to the same cluster. The intercept of the regression line with the E-axis gives $E_0$ and the slope of the linear cluster gives ($\mu\gamma$).

Internal friction angle of the rock. The most robust parameter that is computed on the cluster is the slope $\mu\gamma$ of the friction line. If the bit constant $\gamma$ is known (either through information provided by the bit manufacturer, or by analysis of previously drilled segments), then $\mu$ can be computed and then the internal friction angle of the rock $\phi$ since $\mu=\tan\phi$.

If $\gamma$ is not known, it can generally be set to 1. This value which represents the theoretical lower bound on $\gamma$ is unlikely to be more than 20% different from the true value of $\gamma$. Setting $\gamma$ to 1 will result in an overestimation of $\phi$.

Identification of the cutting point or intrinsic specific energy. The next step is to identify the "lower-left" (LL) point of the cluster which would correspond to the cutting point CP if the drilling efficiency was equal to 1. The point LL corresponds to the best drilling efficiency achieved during the segment of bit run represented by the data cluster. Ideally this point can be unambiguously identified: it corresponds to the minimum drilling strength and specific energy of the cluster and it is close to the friction line calculated by least squares from the drilling data. If some ambiguity exists, e.g. the "left-most" point corresponding to the minimum $S_i$ is not the same as the "lowest" one corresponding to the minimum $E_i$, then the point closest to the regression line is selected. Note that the point must be rejected if it is characterised by a slope $\chi$ greater than 2,5; such a large slope most likely betrays some problems with the measurement of the raw data. Assuming that the LL point has been recognised, let $E^*$ and $S^*$ designate the coordinates of that point, and $\chi^*$ the ratio of $E^*$ over $S^*$.

It is of interest to estimate from the drilling data the intrinsic specific energy, $\epsilon$, because this quantity can be further interpreted in terms of rock mechanical parameters, the mud pressure, and the pore pressure. A lower bound of $\epsilon$ is the intercept $E_0$ of the friction line with the E-axis, while the upper bound is the ordinate $E^*$ of the LL point. Thus $$E_0 < \epsilon \leqq E^*$$

It the bit is new, the LL point can be very close to the cutting point CP ($\eta=1$); i.e. $\epsilon \simeq E^*$. The quality of $E^*$ as an estimate of $\epsilon$ can be assessed from the value of $\chi^*$. At the cutting point, the parameter $\chi$ is equal to $\zeta^{-1}$. For a drillbit with a standard average backrake angle of 15°, the parameter $\zeta$ is typically between 0.5 and 1 and therefore $\chi^*$ should be between 1 and 2. Therefore, $E^*$ will provide a good estimate of the intrinsic specific energy, if $\chi^*$ is between 1 and 2.

For a worn bit, the difference between the lower and upper bounds is too large for these bounds to be useful. An estimate of $\epsilon$ can then be obtained as follows. By assuming a value for $\zeta$, $\epsilon$ can be computed according to equation (13), using the two regression parameters $E_0$ and $(\mu\gamma)$:

$$\epsilon = \frac{E_0}{1 - \mu\gamma\zeta} \tag{29}$$

Bit efficiency. Once $\zeta$ and $\mu\gamma$ have been estimated, the drilling efficiency $\eta_i$ of each data point can be calculated according to equation (18). Alternatively, $\eta$ can be computed from the definition given by equation (16). Then the minimum and maximum efficiency of the linear cluster, designated respectively as $\eta_l$ and $\eta_u$, can be identified.

Contact force. Once $\epsilon$ and $\mu\gamma$ have been estimated, the contact the $(\lambda\sigma)_i$ of each data point can be calculated according to equation (25).

Bit wear. The minimum and maximum efficiency, $\eta_l$ and $\eta_u$, and the contact force $\lambda\sigma$ can be used to assess the state of wear of the bit. As discussed previously, it is expected that the data cluster will stretch and move up the friction line (corresponding to a decrease of the drilling efficiency) as the bit is wearing out. The evolution of $\eta_l$ and $\eta_u$ during drilling will therefore be indicative of the bit wear. A better measure of wear, however, is the contact force $\lambda\sigma$, since $\lambda$ increases as the bit is wearing out. However the impact of wear on the contact force depends very much of the contact strength of the rock being drilled.

Bit balling. The preliminary steps needed to diagnose bit balling are the same as for bit wear: analyse the position of the cluster on the friction line and compute the drilling efficiency and the contact force. Existence of bit balling will reflect in small values of the drilling efficiency and large values of the contact force; in contrast to the low drilling efficiency associated with the drilling of hard rocks with a worn bit, bit balling occurs in soft rocks (mainly shales), irrespective of the fact that the bit is new or worn out. Thus a low average efficiency could be symptomatic of bit balling if the friction coefficient $\mu$ is less than 0.5, and/or if there are points on the cluster that are characterised by a high efficiency.

Change of lithology. Rocks with different properties correspond to friction lines of different slopes and different values for $E_0$. It is therefore easy to identify a change of lithology while drilling, when the drilling data do not belong to the same linear cluster any more, but to a new one.

The above examples on the manner to carry out the invention have been described by plotting a diagram E-S. However, the interpretation of the drilling data could alternatively be processed automatically with a computer algorithm, with no need to plot the values ($E_i$, $S_i$).

EXAMPLES

Laboratory example

The drilling data, used in this example to illustrate the method of interpretation, were gathered in a series of full-scale laboratory tests on Mancos shale samples, using an 8.5" (21.6 cm) diameter step-type PDC bit. The drilling tests were performed at constant borehole pressure, confining stress, overburden stress, and mud temperature, with varying rotational speed, bit weight, and flow rate. The data analysed here were those obtained with a rotary drive system. In these experiments, the rotational speed was varied between 50 and 450 RPM, and 4 nominal values of the WOB were applied: 2, 4, 6, 8 klbfs (8.9, 17.8, 26.7, 35.6 kN). The data corresponding to W=2,000 lbfs (8.9 kN) are characterised by exceedingly small values of the penetration per revolution ($\delta$ of order 0.1 mm). They were left out of the analysis, on the ground that small errors in the measurement of the penetration rate can cause large variations in the computed values of E and S.

Figure 5:
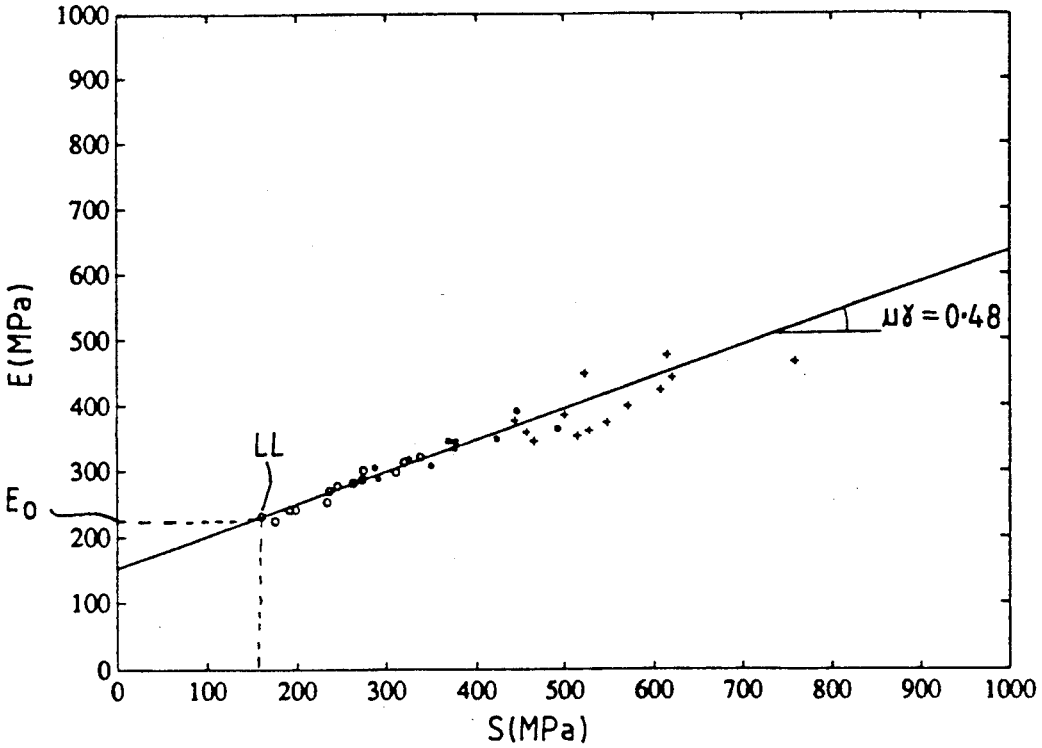
FIG. 5 shows the diagram E-S drawn from drilling data obtained in the laboratory.

The plot E-S of the laboratory data is shown in FIG. 5. The points are coded in terms of the WOB: the circles (o) for 8,000 lbfs (35.6 kN), the asterisks (*) for 6,000 lbfs (26.7 kN) and the plus sign (+) for 4,000 lbfs (17.8 kN). A linear regression on this data set gives the following estimates: $E_0 \simeq 150$ MPa and $\mu\gamma \simeq 0.48$. Assuming that the bit constant $\gamma$ equals 1, the friction angle is approximately 26° (i.e. $\mu = \tan\phi$). This value should be considered as an upper bound of the internal friction angle of the Mancos shale (published values of $\phi$, deduced from conventional triaxial tests, are in the range of 20°-22°). As discussed previously, $E_0$, the intercept of the friction line with the E-axis represents a lower bound of the intrinsic specific energy $\epsilon$; an upper bound being given by the ordinate of the "lower-left" (LL) point of the data cluster. The LL point is here characterised by $E \simeq 230$ MPa and $S \simeq 160$ MPa, and by a ratio $\chi$ equal to about 1.44. This point is likely to be close to the optimal cutting point on the ground that the bit is new and the value of $\chi$ is quite high. Thus here the "lower-left" point LL is estimated to correspond to the cutting point CP and the cutting parameters are estimated to be: $\epsilon = 230$ MPa and $\zeta = 0.69$.

It can be observed from the coding of the points on the plot E-S that the drilling efficiency increases with the WOB in these series of tests. The original data also indicates that the efficiency drops with increased rotational speed on the bit.

Field example 1

The data set used here originates from a drilling segment in an evaporite sequence of the Zechstein formation in the North Sea. The torque and WOB are here measured downhole with a MWD tool. Each data is representative of a one foot (30 cm) interval. The segment of interest has a length of 251' (76.5 m) in the depth range 9,123'-9,353' (2,780-2,851 m), it was drilled with a partially worn PDC bit having a diameter of 12.25" (31.11 cm). The selected interval actually comprises two different sequences of the Zechstein: in the upper part the "Liene Halite", with a thickness of about 175', (53.34 m) and in the lower part, the "Hauptanhydrit", which is about 50' (15.24 m) thick.

Figure 6:
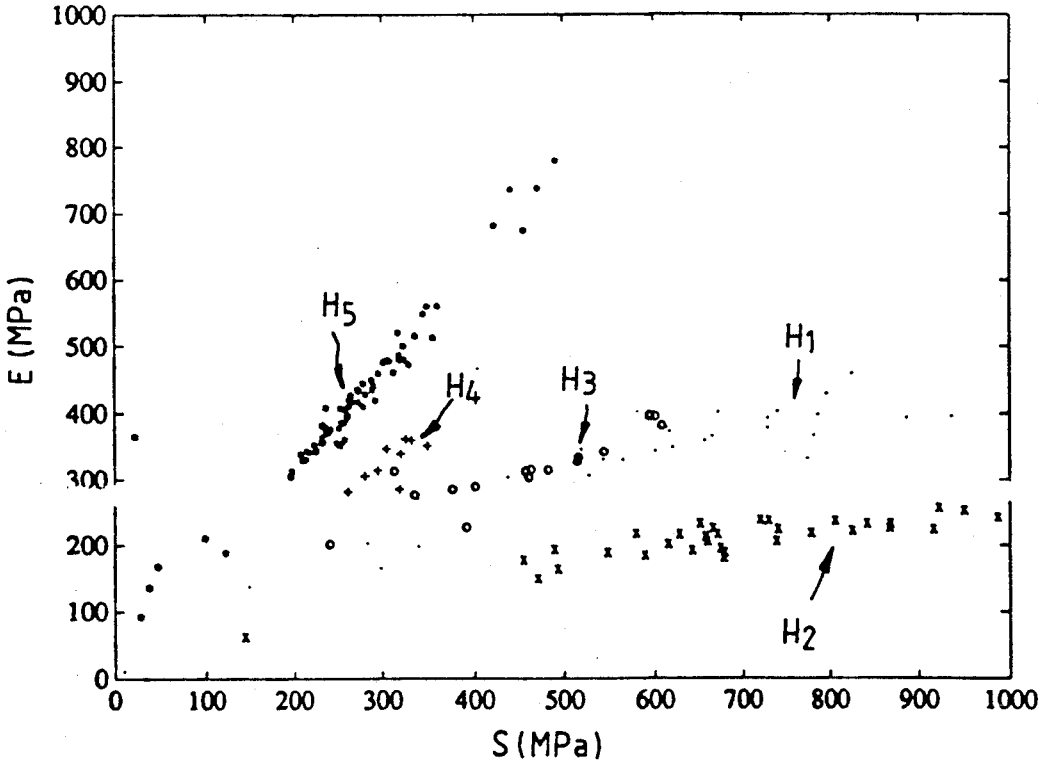
FIGS. 6, 8 and 9 represent the diagrams E-S drawn from drilling data obtained in drilling two different wells.
Figure 7:
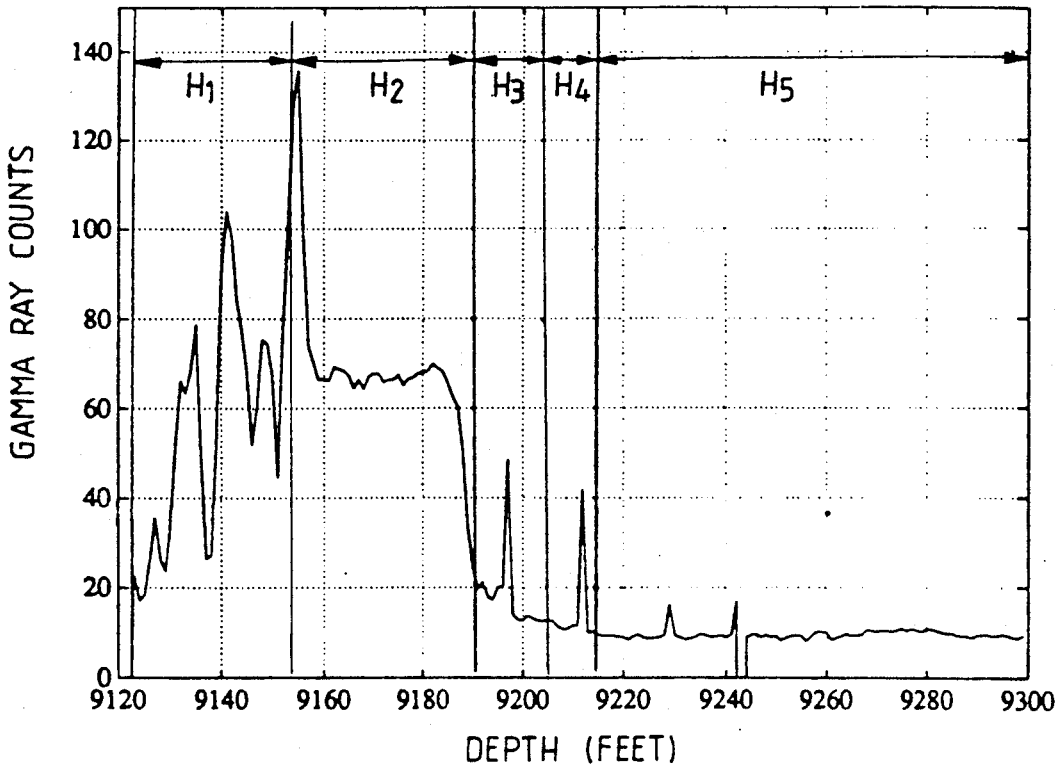
FIG. 7 is a gamma-ray log corresponding to the field example of FIG. 6.

Liene Halite. An analysis of the E-S plot (FIG. 6) for the Liene Halite formation suggests that the data separate into five clusters denoted H1 to H5. Table 1 lists the symbols used to mark the clusters in FIG. 6, and the depth range associated to each cluster. The discrimination of the Liene Halite into 5 sequences H1-H5 and their associated depth interval based on the E-S plot is supported by the geologist report and the gamma-ray log (plotted in FIG. 7). The bed designated as H1 corresponds to gamma-ray values that are moderately high and somewhat erratic. The likely candidate for the lithology of H1 was identified as a mixed salt, possibly Carnalite. The bed H2 corresponds to another salt lithology; it is characterised by very uniform gamma-ray values in the range 60-70. The lithology for H3 is probably a red claystone which was first seen in the cuttings at 9,190' (2,801 m). The gamma-ray for this depth interval shows a transition from the high values of H2 to low values (about 10) characteristic of beds H4 and H5. Finally, cutting analysis and gamma-ray values unmistakedly identify H5 as an halite bed.

TABLE 1

| Sequence | Symbol | Depth Range in feet | (in meters) |
|---|---|---|---|
| H1 | '·' | 9,123-9,154 | (2,780-2,790) |
| H2 | 'x' | 9,155-9,188 | (2,790-2,800) |
| H3 | 'o' | 9,189-9,204 | (2,800-2,805) |
| H4 | '+' | 9,205-9,213 | (2,805-2,808) |
| H5 | '*' | 9,214-9,299 | (2,808-2,834) |

Depth range of the sequences H1-H5 identified in the Liene Halite

The determined values for E and $\mu\gamma$ of the linear regression for each sequence H1-H5 are tabulated in columns 2 and 3 of Table 2. Note that in each group of sequential data points which define any of the beds H1-H5, there are a few "odd" points that could strongly influence the results of a regression calculation (for example the six points in the H5 sequence, that are characterised by a drilling strength S smaller than 100 MPa). For that reason, these points have not been considered for the least squares computation.

TABLE 2

| Sequence | $E_0$(MPa) | $\mu\gamma$ | $\phi$ | $\epsilon$(MPa) |
|---|---|---|---|---|
| H1 | 182. | 0.25 | 14° | 214. |
| H2 | 109. | 0.15 | 8° | 120. |
| H3 | 116. | 0.43 | 23° | 156. |
| H4 | 99. | 0.74 | 37° | 178. |
| H5 | (−3.6) | (1.56) | (57°) | (N/A) |

Computed parameters for the sequences H1-H5 identified in the Liene Hall formation The angle of friction $\phi$ estimated from $\mu\gamma$, where the bit constant $\gamma$ set to 1 is also tabulated in Table 2, column 4. It can be seen that the friction angle for H1 and H2 is estimated at a very low value, consistent with a salt type lithology. For H3, $\phi$ is estimated at 23°, which is compatible with the lithology of H3 being diagnosed as a claystone.

The estimated friction angle for H5 poses a problem however, as the halite is characterised by a friction angle which is virtually zero at the pressure and temperature conditions encountered at those depths. Thus a 'friction line' for a material like halite should be parallel to the S-axis. Applicant assumed that the drilling data for the halite bed are actually located on the cutting locus, i.e. on a line of slope $\zeta^{-1}$ going through the origin of the E-S diagram. Indeed the very low value of the intercept ($E_0 \sim -4$ MPa) and the high value of the slope ($\mu\gamma \sim 1.56$) suggests that this hypothesis is plausible; in which case, $\zeta \sim 0.64$. In this scenario, variation of the drilling response would be caused by variation in the cohesion of the halite. (In competent rocks, the intrinsic specific energy is strongly influenced by the mud pressure, and only moderately by the cohesion c, because c is lost rapidly after little shear deformation; in contrast, the halite remains coherent even after the large deformation, and the $\epsilon$ does not depend on the magnitude of the mud pressure).

Finally, the intrinsic specific energy $\epsilon$ for the sequence H1-H4 is computed from equation (22), assuming that $\zeta=0.6$. The results are tabulated in column 5 of Table 2.

Hauptanhydrit. According to the geologist report, the lithology of the sequence underlying the Liene Halite consists of a fairly pure anhydrite. In the E-S plot of FIG. 8, all the data pertaining to the depth interval 9,305'-9,353' (2,836-2,850 m) appear to define a coherent cluster. This identification of a uniform lithology sequence correlates very well with the gamma-ray log (not shown), which indicates an approximately uniform low gamma-ray count value (below 10) in this depth interval.

Figure 8:
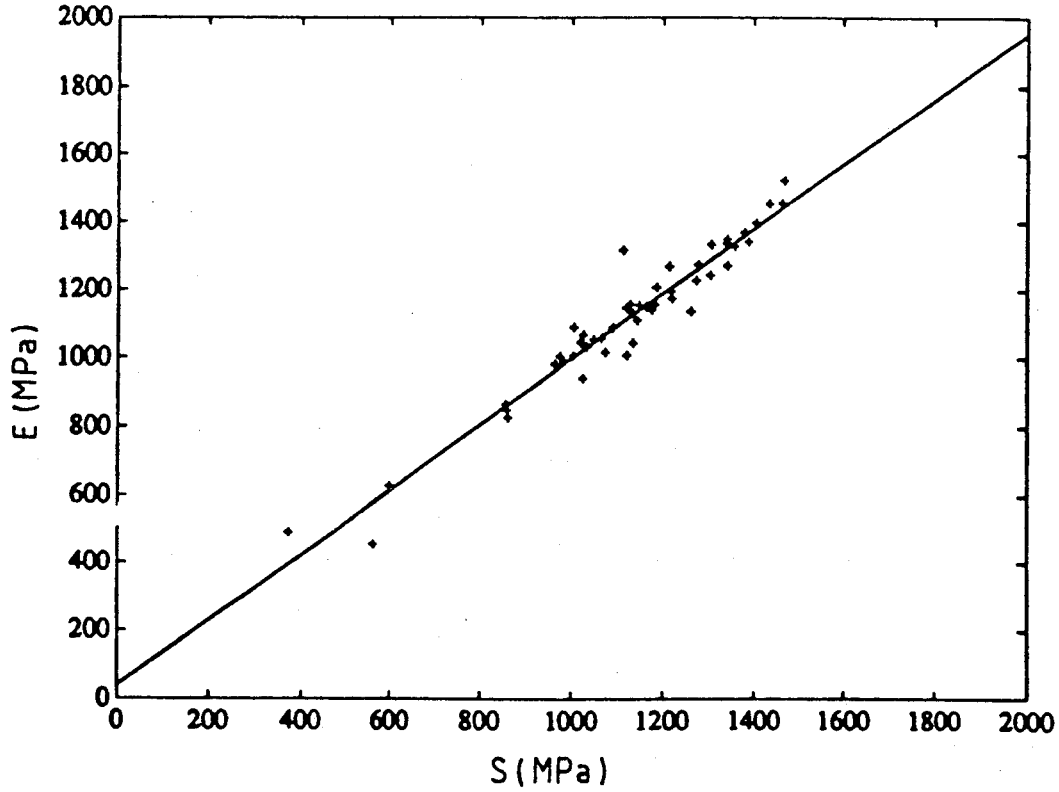

The least squares calculation yields a slope $\mu\gamma \simeq 0.96$ and an intercept $E_0 \simeq 38$ MPa for the regression line, which has also been plotted in FIG. 8. Assuming again $\gamma=1$, the friction angle is estimated at 44°. Using equation (22) and assuming $\zeta=0.6$, the intrinsic specific energy $\epsilon$ is evaluated at 90 MPa. This low estimate of $\epsilon$ is probably suspect: because of the relatively high slope of the friction line, the calculation of $\epsilon$ is very sensitive to the assumed value of $\zeta$ and the estimated value of the intercept $E_0$.

Field example 2

In this example, also from the North Sea, all the drilling data have been obtained by surface measurements.

The segment of hole considered here was drilled with a 12¼" (31.11 cm) diameter bit. This bit has the usual characteristics of having the cutters mounted with a 30° backrake angle. Compared to a bit characterised by a 15° backrake angle, this large value of the rake angle is responsible for an increase of the intrinsic specific energy. The length of hole drilled during this bit run has a length of about 400' (122 m) between the depth 10,300' (3,139 m) and the depth 10,709' (3,264 m). The first 335' (102 m) of the segment was drilled through a limestone formation, and the last 75' (23 m) through a shale. The drilling data were logged at a frequency of one set of data per foot.

Figure 9:
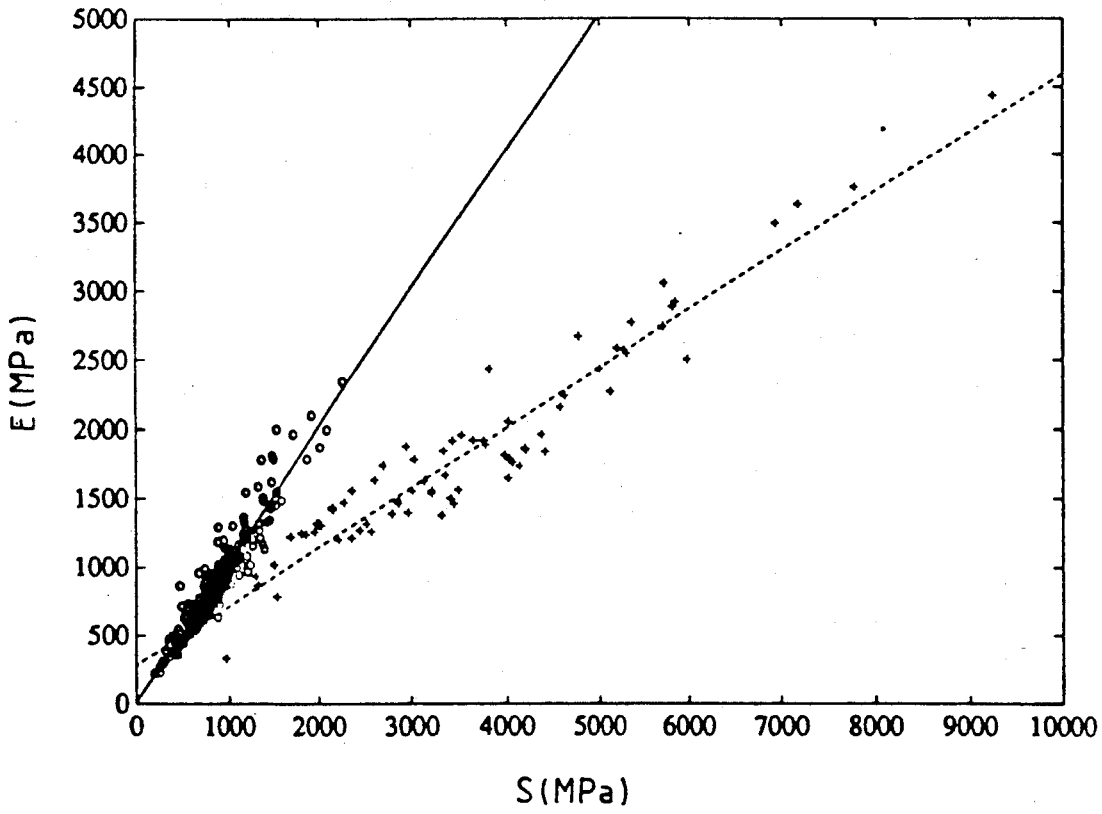

FIG. 9 shows the corresponding E-S plot; the data points for the limestone interval are represented by a circle (o), those for the shale formation by a plus sign (+). The two sets of points indeed differentiate into two clusters. A regression analysis provides the following estimates of the coefficients of the two friction lines. For the limestone: $E_0 \simeq 14$ MPa and $\mu\gamma \simeq 1$; for the shale: $E_0 \simeq 280$ MPa and $\mu\gamma \simeq 0.43$. The low value of the slope of the friction line suggests that the bit constant $\gamma$ is here equal to about 1. The friction angle is estimated to be about 45° for the limestone, and 23° for the shale. The intrinsic specific energy is not calculated here because these surface measurements are not accurate enough to warrant such a calculation.

Finally, there is a strong possibility that the drilling of the shale formation was impeded by bit balling. The shale cluster in the E-S plot is indeed very much stretched. Assuming, as a rough estimate, a value of 50 MPa for the shale specific energy implies that most of the points are characterised by an efficiency in the range of 0.2 to 0.4. This low efficiency in drilling a soft rock indeed suggests that bit balling is taking place.

I claim:

1. A method of monitoring drilling conditions associated with drilling a borehole through subterranean formations comprising:

a) drilling through said subterranean formation with a rotary drag bit;

b) measuring weight applied to the bit W, bit torque T, angular rotation speed of the bit $\omega$ and rate of penetration of the bit $\nu$ so as to obtain sets of data (Wi, Ti, $\omega$i, $\nu$i) each corresponding to a different depth of drilling;

c) calculating specific energy E and drilling strength S from each set of data according to the relationships $E=2T/a^2\delta$ and $S=W/a\delta$, wherein a is the bit radius and $\delta$ is the depth of cut per revolution calculated as $\delta=2\pi\nu/\omega$;

d) building up a history of points in the ES plane;

e) identifying any linear clusters of points in said plane corresponding to a particular lithology of formation; and f) using said linear clusters for determining the drilling conditions associated with each linear cluster, at least one of said conditions being selected from the group consisting of intrinsic specific energy of formation, internal friction angle of rock, bit balling, drilling efficiency, change in lithology and bit wear.

2. The method of claim 1, further comprising the step of determining the slope of said linear cluster, said slope being defined as the ratio of the variation of E over the corresponding variation of S and said slope being related to the product of a bit constant $\gamma$ and a friction coefficient $\mu$.

3. The method of claim 2, further comprising the step of computing the value of said friction coefficient $\mu$ from said slope and from a known or estimated value of $\gamma$.

4. The method of claim 3, further comprising the step of deriving an indication of the internal friction angle $\phi$ of the formation from the value of said friction coefficient $\mu$.

5. The method of claim 2, further comprising the steps of estimating the intrinsic specific energy $\epsilon$ by the following relationship:

$$\epsilon = \frac{E_0}{1 - \mu\gamma\zeta}$$

wherein $E_0$ is the intercept of the extension of said linear cluster with the E-axis of the ES space, $\mu\gamma$ is said slope and $\zeta$ is a constant.

6. The method of claim 5, further comprising the step of estimating an amount $E^f$ of the drilling energy spent in frictional process at a certain depth by comparing the value $E_i$ at said depth with said intrinsic specific energy $\epsilon$.

7. The method of claim 1, further comprising the step of determining the efficiency $\eta$ of the drilling process at a particular depth by finding out in the linear cluster the position of the pair ($E_i$, $S_i$) corresponding to said particular depth.

8. The method of claim 7, wherein the highest efficiency achieved when drilling said particular lithology is determined by identifying the minimum value of $E_i$ and $S_i$, said minimum value corresponding to said highest efficiency.

9. The method of claim 7, further comprising the step of estimating the intrinsic specific energy $\epsilon$ from the minimum value of $E_i$.

10. The method of claim 9, further comprising the step of estimating an amount $E^f$ of the drilling energy spent in a frictional process at a certain depth by comparing the value $E_i$ at said depth with said intrinsic specific energy $\epsilon$.

11. The method of claim 1, further comprising the step of estimating the efficiency of the drilling process at a certain depth by computing the ratio $E_i/S_i$ at said depth.

12. The method of claim 7 or 11, further comprising the step of estimating the values $(E_i, S_i)_M$ associated with the cutting point which corresponds to an efficiency $\eta$ equal substantially to 1 and determining the locus of all the cutting points whose coordinates ($E_i$, $S_i$) correspond to a drilling efficiency substantially equal to 1 when there is a change in the pore pressure of the formation and/or in the drilling fluid pressure, said locus being determined by a linear relationship including the pair (E=0, S=0) and said pair $(E_i, S_i)_M$.

13. The method of claim 7 or 11, further comprising the step of detecting a bit balling event by comparing the successive values of the drilling efficiency computed as the drilling progresses in a soft formation and identifying small values of the drilling efficiency.

14. The method of claim 13, wherein the step of detecting a bit balling event further comprises the determination of the value of the friction coefficient $\mu$ and declaring a bit balling even if said value of $\mu$ is less than 0.5.

15. The method of claim 1, further comprising the step of estimating the state of wear of the drillbit by following the evolution of the values E and S while drilling, a sharp drillbit being characterized by relatively small values of E and S and these values increasing with the wear of the drillbit resulting in a stretch of said linear cluster towards higher values of E and S.

16. The method of claim 1, further comprising the detection of a change of lithology by identifying the beginning of another linear cluster having a different slope from the slope of said one linear cluster, the drilling fluid pressure $p^h$ having been kept relatively constant.

17. The method of claim 1, wherein at least part of the data ($W_i$, $T_i$, $\nu_i$, $\omega_i$) are average values of W, T, $\nu$ and $\omega$ over predetermined depth intervals.

18. The method of claim 1, wherein said linear cluster of values ($E_i$, $S_i$) corresponds to the following equation:

$$E=E_0+\mu\gamma S$$

wherein $\gamma$ is a bit constant and $\mu$ is a friction coefficient.

19. The method of claim 18, wherein $$E_0=(1-\gamma\mu\zeta)\epsilon$$

$\epsilon$ being the intrinsic specific energy of the formation and $\zeta$ being a quantity related to the friction at the interface between the cutting face of the cutter and the rock.

20. The method of claim 19, wherein $$\zeta=\tan(\theta+\psi)$$

$\theta$ being the backrake angle of the drillbit cutters and $\zeta$ being a quantity related to the friction angle $\psi$ at the interface between the cutting face of the cutter and the rock.

21. The method of claim 1, wherein the different values ($E_i$, $S_i$) are represented in a diagram E-S.

22. The method of claim 1, further comprising the step of varying at least one of the drilling parameters, weight-on-bit W and rotation speed $\omega$, in order to define more precisely said linear cluster.

23. The method of claim 1, further comprising the step of determining the slope of each linear cluster and determining drillbit efficiency from said slope.

24. The method of claim 23, wherein the efficiency of at least two drag drillbits are determined and compared; the drillbit of higher efficiency being identified with the linear cluster of lower slope.

25. A method as claimed in claim 1, wherein the difference between a pair of values ($E_i$, $S_i$) from each linear cluster of similar values is used to identify an event affecting drilling.

26. The method of claim 1, wherein the contact length $\lambda$ and the contact stress $\sigma$ are determined and the development of the contact force $\lambda\sigma$ is monitored to determine changes in bit wear and lithology.

* * * * *